US009527658B2

(12) United States Patent
Martin

(10) Patent No.: US 9,527,658 B2
(45) Date of Patent: Dec. 27, 2016

(54) METERING VALVE FILLABLE THROUGH THE VALVE

(71) Applicant: James H. Martin, Burr Ridge, IL (US)

(72) Inventor: James H. Martin, Burr Ridge, IL (US)

( * ) Notice: Subject to any disclaimer, the term of this patent is extended or adjusted under 35 U.S.C. 154(b) by 115 days.

(21) Appl. No.: 13/962,077

(22) Filed: Aug. 8, 2013

(65) Prior Publication Data

US 2014/0042190 A1 Feb. 13, 2014

Related U.S. Application Data

(60) Provisional application No. 61/680,911, filed on Aug. 8, 2012.

(51) Int. Cl.

| | |
|---|---|
| ***B65B 31/00*** | (2006.01) |
| ***B65D 83/54*** | (2006.01) |
| ***B65D 83/42*** | (2006.01) |

(52) U.S. Cl.

CPC ..... *B65D 83/546* (2013.01); *B65D 83/42* (2013.01); *B65D 83/425* (2013.01)

(58) Field of Classification Search

CPC ..... B65D 83/425; B65D 83/42
USPC ..... 141/3, 20
See application file for complete search history.

(56) References Cited

U.S. PATENT DOCUMENTS

| | | | | |
|---|---|---|---|---|
| 4,892,232 | A | 1/1990 | Martin | |
| 5,085,351 | A | 2/1992 | Martin | |
| 5,105,995 | A * | 4/1992 | Martin | B65D 83/54 128/200.14 |
| 5,183,187 | A | 2/1993 | Martin | |
| 5,199,616 | A | 4/1993 | Martin | |
| 5,484,088 | A | 1/1996 | Martin | |
| 6,695,175 | B2 | 2/2004 | Martin et al. | |
| 6,910,606 | B2 | 6/2005 | Martin et al. | |
| 7,575,134 | B2 | 8/2009 | Martin et al. | |
| 2002/0179736 | A1 * | 12/2002 | Ogata | B65D 83/425 239/340 |
| 2005/0005995 | A1 * | 1/2005 | Pericard | B65B 31/003 141/20 |

FOREIGN PATENT DOCUMENTS

DE 10 2008 006 686 A1 * 1/2008 ..... F16K 15/02

* cited by examiner

*Primary Examiner* — Jason K Niesz
(74) *Attorney, Agent, or Firm* — Law Office of John W. Harbst

(57) ABSTRACT

A metering valve has an elongate axially moveable stem having a discharge passage. A flexible bag for containing a formulation to be discharged surrounds the lower end of the metering valve. The valve is fillable through a fill passage having one end opening to the ambient and the other end opening into the bag. A one-way valve in the fill passage prevents liquid in the bag from escaping through the fill passage but allows the bag to be filled after the lower end of the valve and the bag are inserted into a container and the container pressurized with a propellant.

21 Claims, 13 Drawing Sheets

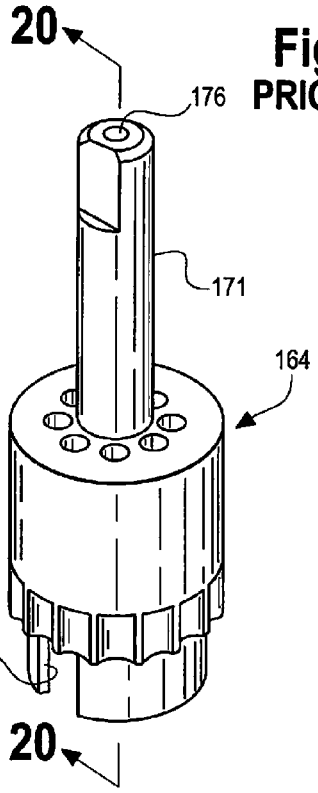
Fig. 19
PRIOR ART
Fig. 20
PRIOR ART
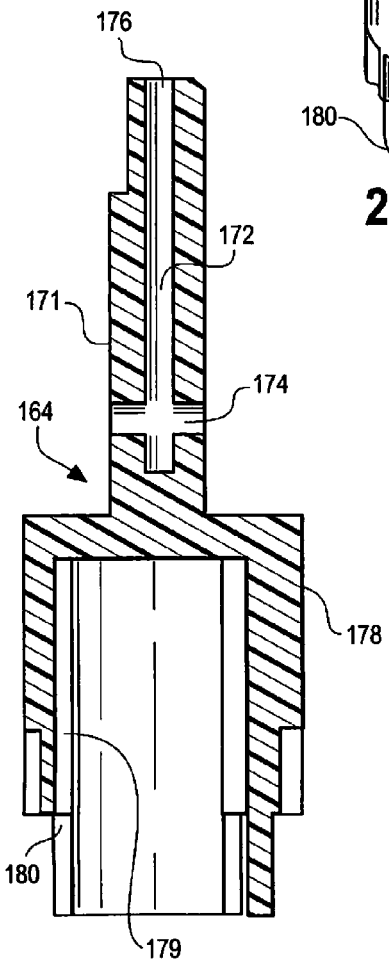
Fig. 21
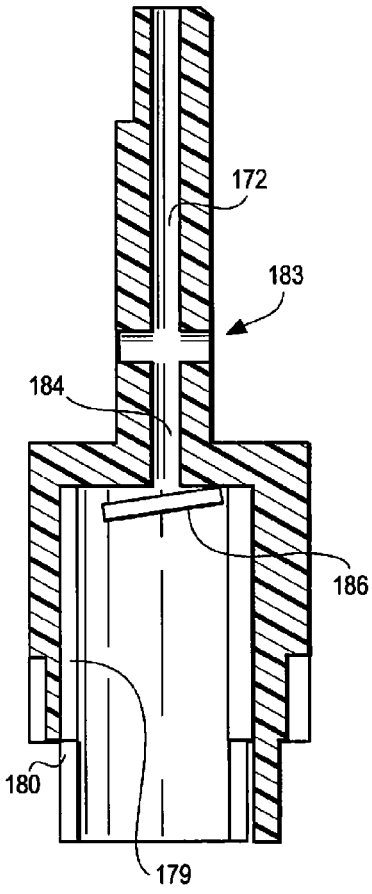

METERING VALVE FILLABLE THROUGH THE VALVE

The applicant claims priority from his provisional application filed Aug. 8, 2012 and assigned Ser. No. 61/680,911. The present invention relates to the filling of a container having a valve that dispenses a fixed amount of liquefied formulation from a container upon each actuation of the dispenser.

BACKGROUND OF THE INVENTION

Unit dose dispensers, or dispensers having metering valves that discharge predetermined volumes of liquefied formulation, are known in the art. Where the formulation includes medication for certain specific purposes, such as a medication for use in the nasal passages, a metering valve that discharges fixed volumes of medication at each discharge is desired. Several such valves are disclosed in the following references: U.S. Pat. No. 4,892,232; U.S. Pat. No. 5,105,995; U.S. Pat. No. 5,085,351; U.S. Pat. No. 5,183,187; U.S. Pat. No. 5,484,088; U.S. Pat. No. 6,695,175 B2; and U.S. Pat. No. 6,910,606 B2. Existing metering valves discharge liquefied formulation from a pressurized container that is filled either prior to attaching the valve at the upper end of the container, or through a port at the bottom of the container; however, it is often desirable to fill the formulation through the metering valve. For example, formulations that include an evaporant such as needed to create a mist or foam are retained in a bag within the container, with the bag surrounded by a propellant. The propellant pressurizes the bag and thereby retaining the liquefied gas in its liquid state.

It should be noted that existing adjustable metering valves are not suitable for discharging a formulation that includes a liquefied gas that is retained in liquid form by the propellant. This is because the liquefied evaporant turns to gas as soon as the valve opens the metering chamber to the ambient thereby causing all the formulation in the metering chamber, not just the portion adjacent a moveable metering wall, to be discharged trough the valve. However, unit dose valves that are not adjustable can discharge a fixed amount formulation, including an evaporant, on each depression of a the valve actuator.

In order for such a metering valve to discharge a formulation that includes a liquefied gas, the formulation must be maintained under pressure while it is being inserted into a bag within the container. The bag must therefore have a single port through which the contents thereof are both filled and discharged. That is, the bag must be filled through the dispensing valve which extends into the bag. All metering valves release a predetermined volume of formulation on each actuation do not permit the filling of the formulation through the stem of the valve.

Beard, U.S. Pat. No. 3,104,785 discloses a metering valve that can be filled through the stem of the valve and discharges a fixed amount of formulation on each actuation; however, Beard requires that the dispensing stem be in a depressed condition at the time the liquid is filled through the metering valve. There is therefore a need for an improved metering valve that dispenses a fixed volume of formulation on each actuation and through which the container can be filled.

BRIEF DESCRIPTION OF THE INVENTION

Briefly, the present invention is embodied in a dispensing device that includes a container with an aperture, and a metering valve having one end fitted in the aperture. The metering valve is of the type that dispenses a predetermined volume of liquid formulation on each discharge and has an elongate body with an upper end that extends into the ambient and a lower end that extends into the container. The container may include a bag that surrounds and encloses the lower end of the metering valve into which the formulation to be discharged is to be inserted. Also within the container is a propellant that surrounds the bag and compresses the bag and forces the liquefied formulation into a metering chamber in the valve. The valve also includes an axially aligned stem with an axial passageway therein. The stem is moveable from an upward position in which the passage is closed off from the metering chamber and a lowered position in which the passage communicates with the metering chamber and a fixed volume of formulation in the metering chamber is discharged through the through the stem. A structure in the lower end of the valve allows liquid in the bag to fill the metering chamber when the stem is in the upward position.

In accordance with the present invention, a connecting passage is provided in the valve body having one end which opens at the lower portion of the valve that extends into the container and the other end which open to the ambient. A one-way valve in the connecting passage permits the liquid formulation to be injected into the container through the body of the valve, but prevents the formulation within the container from escaping out the connecting passage.

In accordance with another aspect of this invention disclosure, there is provided a method for filling a dispensing device. The dispensing device includes a container having an aperture and a discharge valve in the aperture. The discharge valve includes a dispensing structure for dispensing a volume of liquid formulation on each actuation of the valve. The discharge valve also includes an axially moveable stem with an upper portion extending to ambient and a lower portion extending within the container. A fill passage is defined by the discharge valve. A bag is provided in the container. The bag encloses the lower portion of the discharge valve. A propellant surrounds and provides pressure within the bag. A liquid formulation is in the bag. The method comprises the steps of: configuring the discharge valve such that the fill passage opens to ambient and opens to the bag; permitting liquid formulation to flow through the fill passage from ambient into said bag; and, preventing the liquid formulation in the bag to flow through the fill passage to ambient whereby allowing the bag to be filled with liquid formulation from outside the dispensing device.

Preferably, the above-mentioned method furthermore includes the step of: rotating the stem to preselected rotational positions to control the volume of liquid formulation dispensed from the dispensing device. In a preferred embodiment, the method further includes the step of: providing the discharge vale with a metering chamber such that the discharge valve discharges a predetermined amount of liquid formulation on each actuation of the discharge valve.

BRIEF DESCRIPTION OF THE DRAWINGS

A better understanding of the invention will be had after a reading of the following detailed description taken in conjunction with the drawings wherein:

FIG. 19 is an isometric view of the stem for the valve shown in FIGS. 17 and 18;

FIG. 20 is a cross-sectional view of the stem shown in FIG. 19;

FIG. 21 is a cross-sectional view of a stem in accordance with the present invention that will replace the stem shown in FIGS. 19 and 20;

DETAILED DESCRIPTION OF PREFERRED EMBODIMENT

Figure 1:
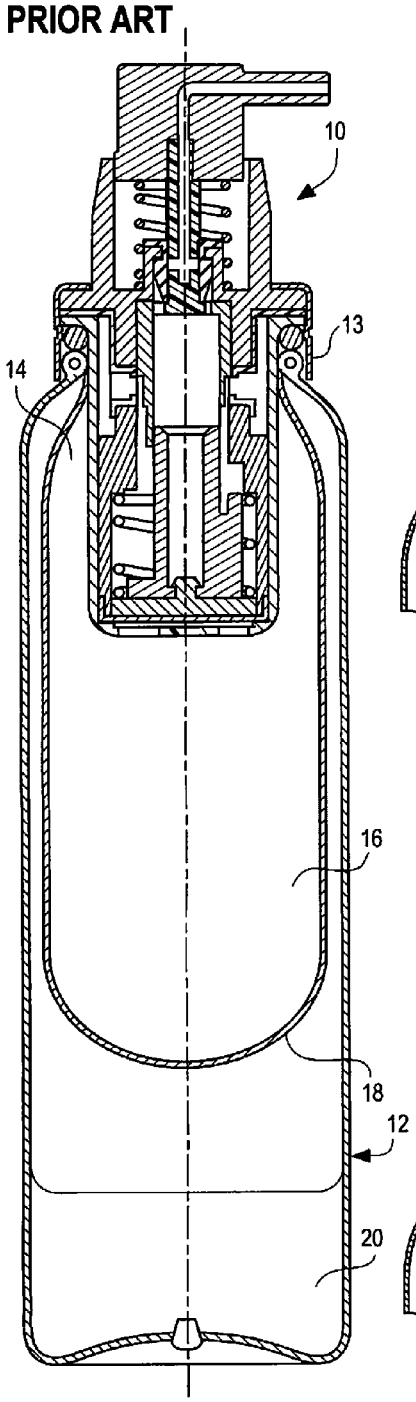
Fig. 1 PRIOR ART
FIG. 1 is a cross-sectional view of a dispensing device in accordance with the present invention.
Figure 2:
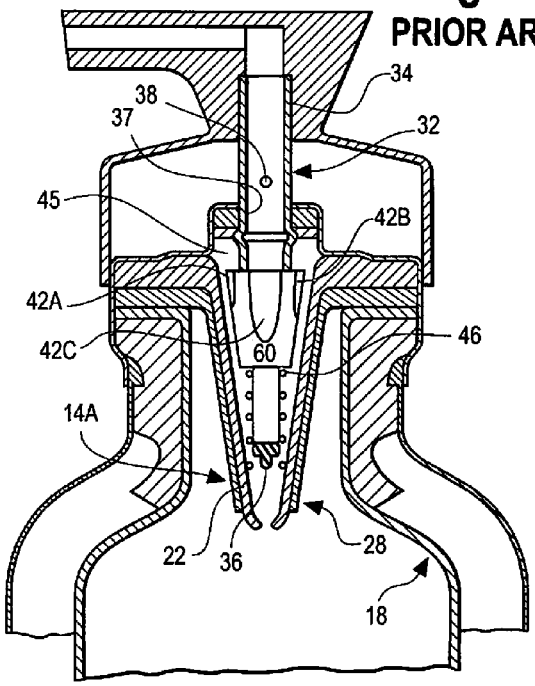
Fig. 2 PRIOR ART
FIG. 2 is a cross-sectional view of a first valve 14A according to the prior art with the stem in the elevated position.

Referring to FIG. 1, a dispensing device 10 in accordance with the present invention includes a container 12 having an upper open end 13 into which is inserted a metering valve 14 with a moveable stem 15 for dispensing a fixed amount of liquid formulation 16 that is retained within a flexible bag 18 inside the container 12. Also within the container 12, and surrounding the bag 18 is a propellant 20 that applies pressure to the bag 18 for expelling the formulation 16 through the metering valve 14. The axially moveable stem 15 actuates the valve 14 when moved from an upper position to a lower position. Accordingly, on each actuation of the stem 15 a predetermined amount of the liquefied formulation 16 is expelled through a passage in the stem.

It is sometimes necessary to maintain the formulation under pressure while it is being injected into the bag. To do this, the formulation 16 must be inserted into the bag 18 after the propellant 20 has been injected into the container 12. This is to say, that the formulation 16 must be inserted through the metering valve 14.

Existing metering valves, in particular valves for which the volume of liquid dispensed can be adjusted by the operator cannot be filled through the stem. The present invention is an improvement to existing metering valves and therefore this discussion will include a review of several existing metering valves and will describe the elements required to convert such valves so as to be fillable through the body of the valve. There are several embodiments of the invention, but all embodiments relate only to the valve 14, and therefore the other elements of the dispensing device 10, including the container 12, the formulation 16, the flexible bag 18, and the propellant 20 will all bear the same indicia numbers throughout this discussion. The various existing prior art metering valves will be identified as bearing indicia numbers 14A, 14B, 14C etc. Existing metering valves can generally be referred to as falling into two categories, the first of which has a flexible membrane that determines one wall of the metering chamber, and the second of which has a piston that determines one wall of the metering chamber.

Referring to FIGS. 2, 3, 4, 5, and 6, a metering valve 14A is depicted that is in accordance with my U.S. Pat. No. 5,085,351, which is incorporated herein by reference. Since all the elements of valve 14A and its operation are described in the patent, only those parts that pertain to the present invention will be described in detail. The key elements of valve 14A include a rigid tubular member 22, the outer surface of which is frustoconical and has a radial flange 24 at the upper end thereof that extends around the central opening 13 of the container 12. The tubular member 22 further has a trapezoidal-shaped window 26 in the wall thereof, the window opening into the central opening of the member 22. Fitted around the circumference of the rigid tubular member 22 is a tubular flexible member 28 that also includes a radial flange 30 at the upper end thereof. The radial flange 30 is sandwiched between the flange 24 of member 22 and the central opening 13 of the container 12 and the parts are clamped together by a suitable retaining member. Axially moveable within the rigid tubular member 22 is an elongate stem 32 having an upper end 34 that extends outward of the container 12 to the ambient and a lower end 36 that extends through the central opening of the rigid tubular member 22. The upper end 34 of the stem 32 is tubular with a passageway 37 therein with the upper end opening to the ambient and a lower end opening at a transverse port 38 midway along the length of the stem 32. Below the port 38 is an enlarged frustoconical portion 40 having a plurality of indentations 42A, 42B, 42C therein of which indentation 42A indents only slightly into the frustoconical surface 40, indentation 42B indents a little further into the frustoconical portion 40, and indentation 42C indents the deepest into the frustoconical portion 40.

The stem 32 is vertically moveable through a tubular retainer 44 that retains the valve 14A in the central opening 13 and the lower surface of the retainer 44 defines the upper end of a metering chamber 45. The stem 32 is retained in an upward position shown in FIG. 2 by a coil spring 46 when the valve 14A is not dispensing liquid. When in this position the frustoconical portion 40 of the stem 32 is spaced from the inner surface of the tubular member 22 as shown, and the spacings around the tubular member 22 and below the tubular retainer 44 form the metering chamber 45. Liquid formulation 16 from within the flexible bag 18 enters through the bottom opening of the tubular member 22 and fills the chamber 45 while the stem 32 remains in its upward orientation.

Figure 3:
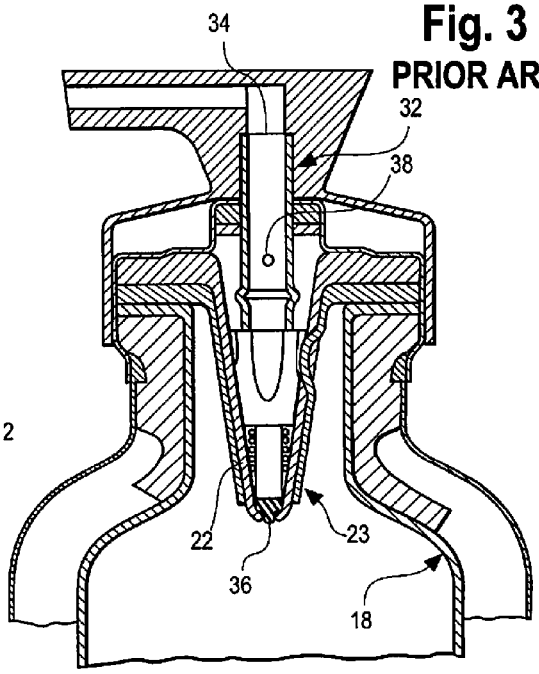
Fig. 3 PRIOR ART
FIG. 3 is a second view of the valve shown in FIG. 2 with the stem depressed.
Figure 4:
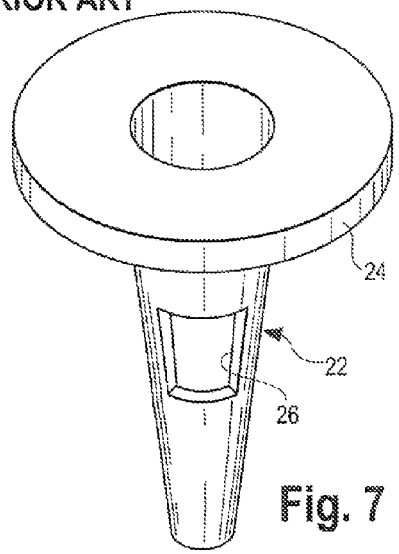
Fig. 4 PRIOR ART
FIG. 4 is an isometric view of a rigid member within the valve shown in FIGS. 2 and 3.
Figure 5:
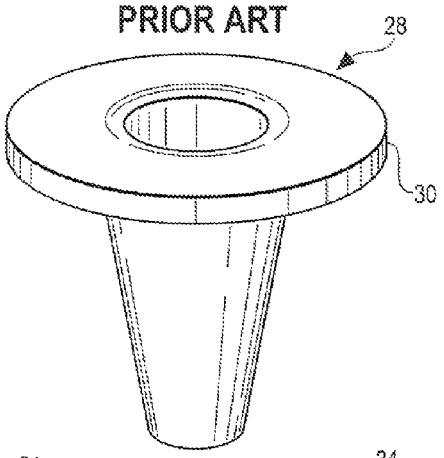
Fig. 5 PRIOR ART
FIG. 5 is an isometric view of a flexible member that surrounds the rigid member shown in FIG. 4.
Figure 6:
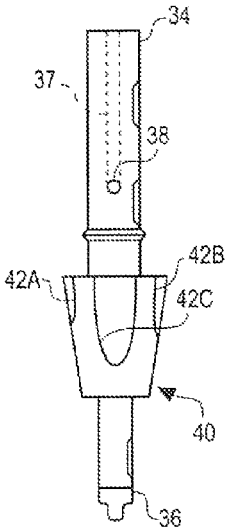
Fig. 6 PRIOR ART
FIG. 6 is a side elevational view of the stem in the valve shown in FIGS. 2 and 3.

To operate the valve 14A, the stem 32 is first rotated until the indentation 42A, 42B, 42C for the desired dosage is oriented against the window 26 in tubular member 22. When the stem 32 is then depressed against the spring 44 as shown in FIG. 3, the frustoconical portion 40 moves axially downward and the surface thereof contacts the frustoconical inner surface of the tubular member 22 and seals off the chamber 45 from the interior of the bag 18. At the same time the port 38 is moved downwardly into the chamber 45, and pressure caused by the propellant 20 compresses the portion of the flexible member 28 adjacent the window 26 into the adjacent indentation 42A, 42B, 42C of the frustoconical portion 40. Compressing the flexible member 28 urges a predetermined volume of the liquid formulation 16 into the port 38 and through passageway 37 in the upper end of the stem 32 to the ambient. As can be seen, by rotating the stem 32 until the desired indentation 42A, 42B, 42C is positioned adjacent the window 26, one can select the desired volume of liquid to be dispensed.

Figure 7:
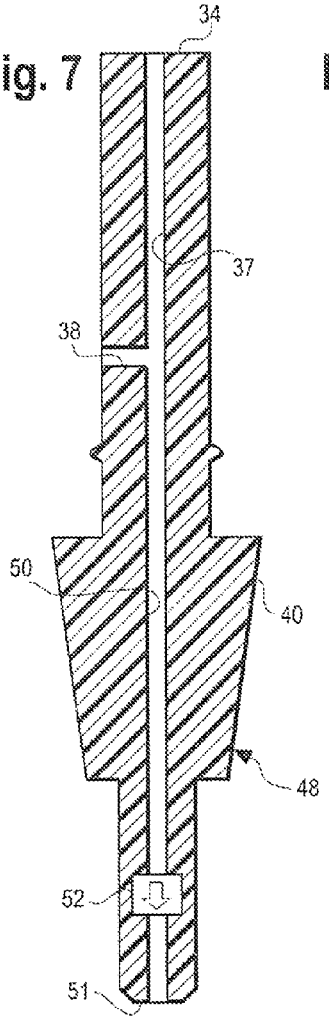
FIG. 7 is an enlarged cross-sectional view of a stem in accordance with the present invention for insertion into the valve shown in FIGS. 2 and 3.

Referring to FIG. 7, the valve 14A as disclosed in U.S. Pat. No. 5,085,351 cannot be filled through the stem; however, by replacing the stem 32 with a replacement stem 48 the valve 14A is fillable through the stem. The stem 48 is identical to the stem 32 as previously described except that it includes a second passage 50 having an upper end that communicates with the dispensing passage 37 and a lower end 51 that opens out the lower end of stem 48. Within the passage 50, between the passage 37 and the lower end 51 is a one-way valve 52 that allows liquid to flow downward from the upper passage 37 of the stem through the passage 50 to the lower end 51, but does not allow liquid to flow in the reverse direction; that is, it does not allow liquid to flow from the lower end 51 to the passage 37.

Figure 8:
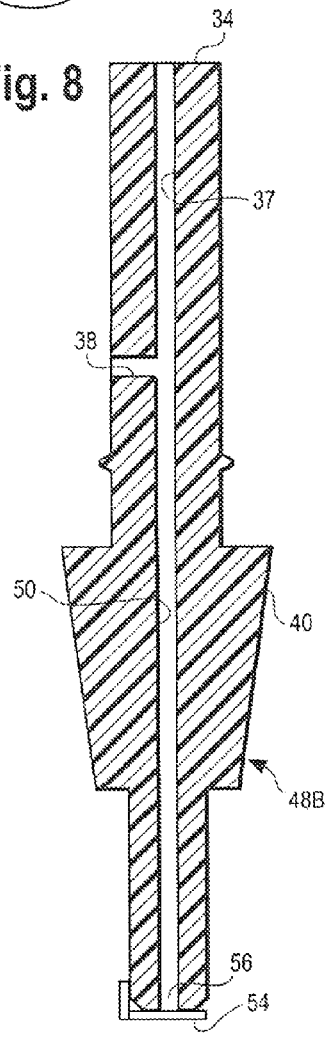
FIG. 8 is a fragmentary enlarged cross-sectional view of a second stem in accordance with the present invention for use in the valve shown in FIGS. 2 and 3.

Referring to FIG. 8 in which a modified stem 48A of valve 14A is depicted. In this embodiment the one-way valve that prevents the flow of liquid from the lower end of the stem to the upper end is in the form of a flexible flap 54 that extends across the opening in the lower end 51 of the stem 48A. The flap 54 is retained against the opening 56 that leads into passage 50 to thereby block liquid in the container from entering passage 50. When pressurized liquid is forced into the open upper end 34 of the stem 48A and through passage 50, the liquid will urge the flap 54 out of the way and allow liquid to enter the bag to thereby fill the dispenser. When the container is not being filled pressurized liquid in the bag will press the flap 54 against the opening 56 and close the opening 56.

Figure 9:
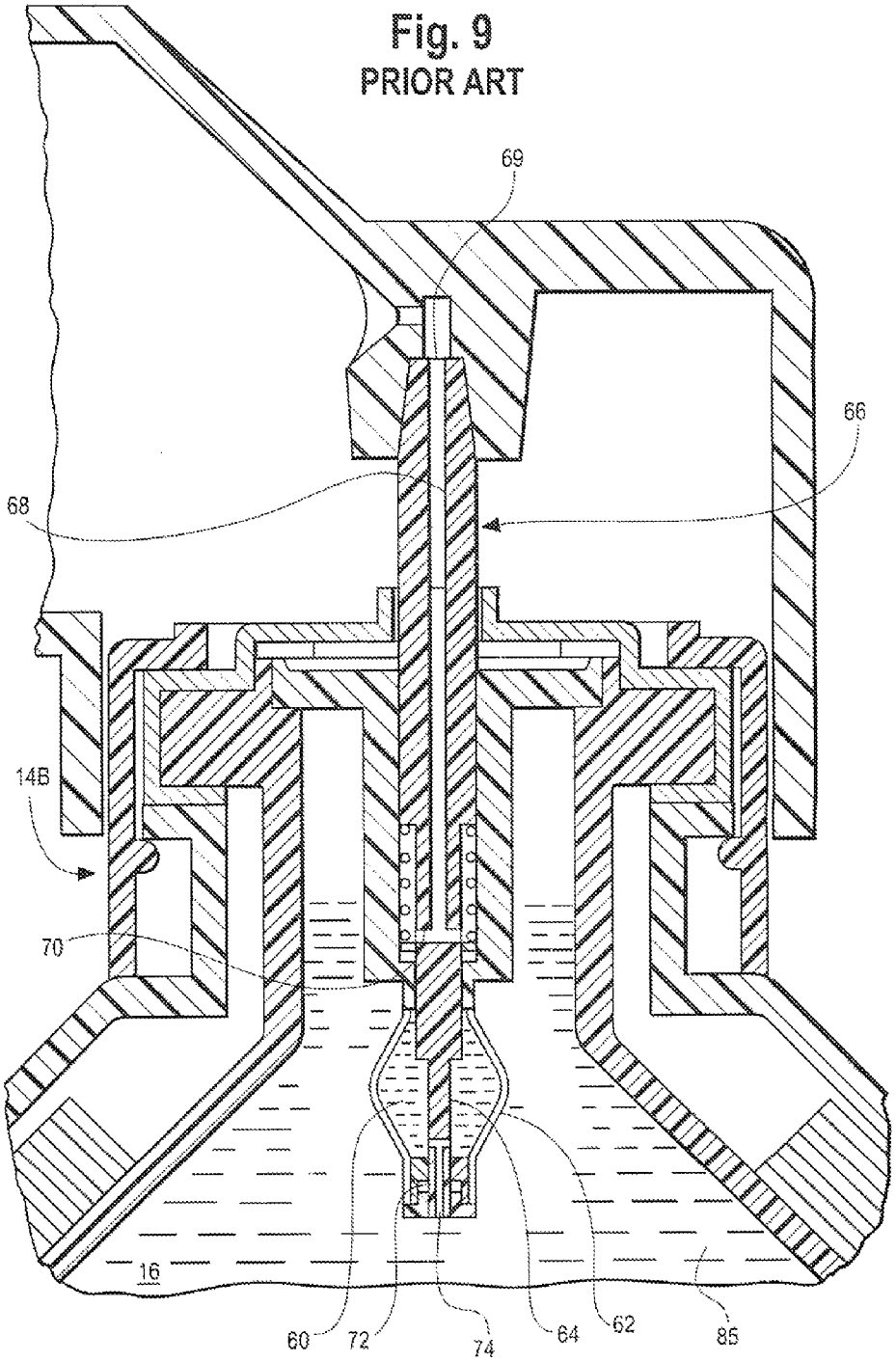
Fig. 9 PRIOR ART
FIG. 9 is a cross-sectional view of a second valve 14B in accordance with the prior art, with the stem of the valve in the elevated position and the metering chamber full.
Figure 10:
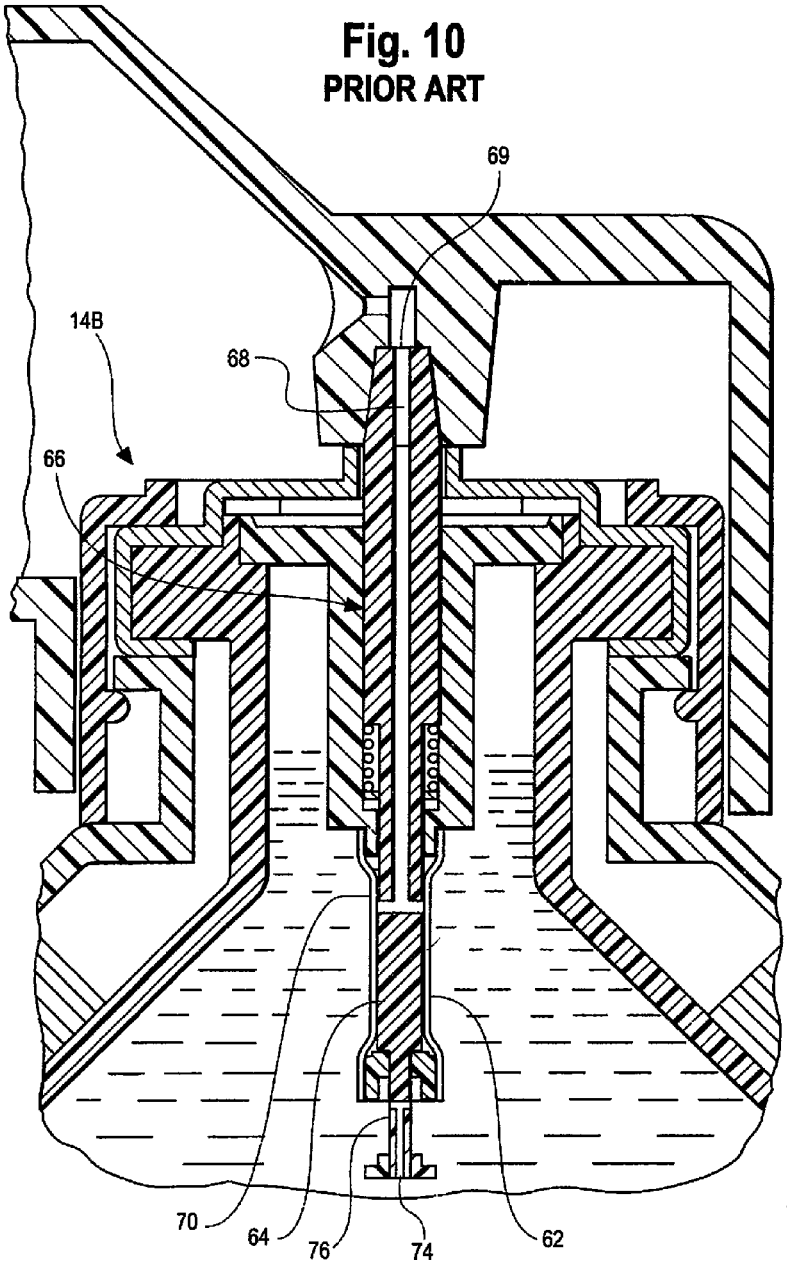
Fig. 10 PRIOR ART
FIG. 10 is a cross-sectional view of the valve shown in FIG. 9 with the stem depressed and the metering chamber empty.

Referring to FIGS. 9 and 10 in which a second valve according to my prior U.S. Pat. No. 4,892,232 is depicted. This valve 14B dispenses a single unadjustable dosage determined by the volume in a dispensing chamber 60 that extends between the inner wall of a flexible membrane 62 and the lower body 64 of the vertical moveable stem 66. In this embodiment, a passageway 68 extends through the upper end of the stem 66 from an opening 69 in the upper end down to a port 70 midway along its length. Another passageway 72 at the lower end of the stem has one end opening at the distal end 74 of the stem, and the second end of the passage 72 opening at a port 76 spaced some distance below the port 70. When the stem 66 is in the elevated position, as shown in FIG. 9, the port 76 is positioned in the chamber 60 allowing liquid formulation to fill the chamber 60 and the port 70 is withdrawn from the chamber 60 thereby preventing release of liquid to the ambient. Downward movement of the stem 66 to the position shown in FIG. 10 moves the port 76 of the lower passage 72 out of the chamber 60 thereby preventing further formulation 16 from entering the chamber 60 and moves the upper port 70 into the chamber 60, thereby allowing the contents of the chamber 60 to be expelled to the ambient.

Figure 11:
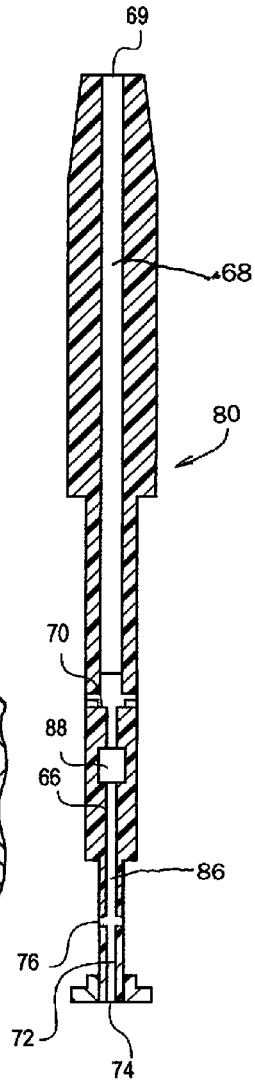
FIG. 11 is a cross-sectional view of a stem in accordance with the present invention useable in the valve shown in FIGS. 9 and 10.

Referring to FIG. 11, the valve 14B can be made fillable through a replacement stem 80 which includes an additional passage 86 that connects the upper passage 68 to the lower passage 72. Midway along the length of the new passage 86 is a one-way valve 88 that permits liquid to flow downwardly through the stem 80 but does not permit liquid to flow from the lower end to the upper end and the ambient.

Figure 12:
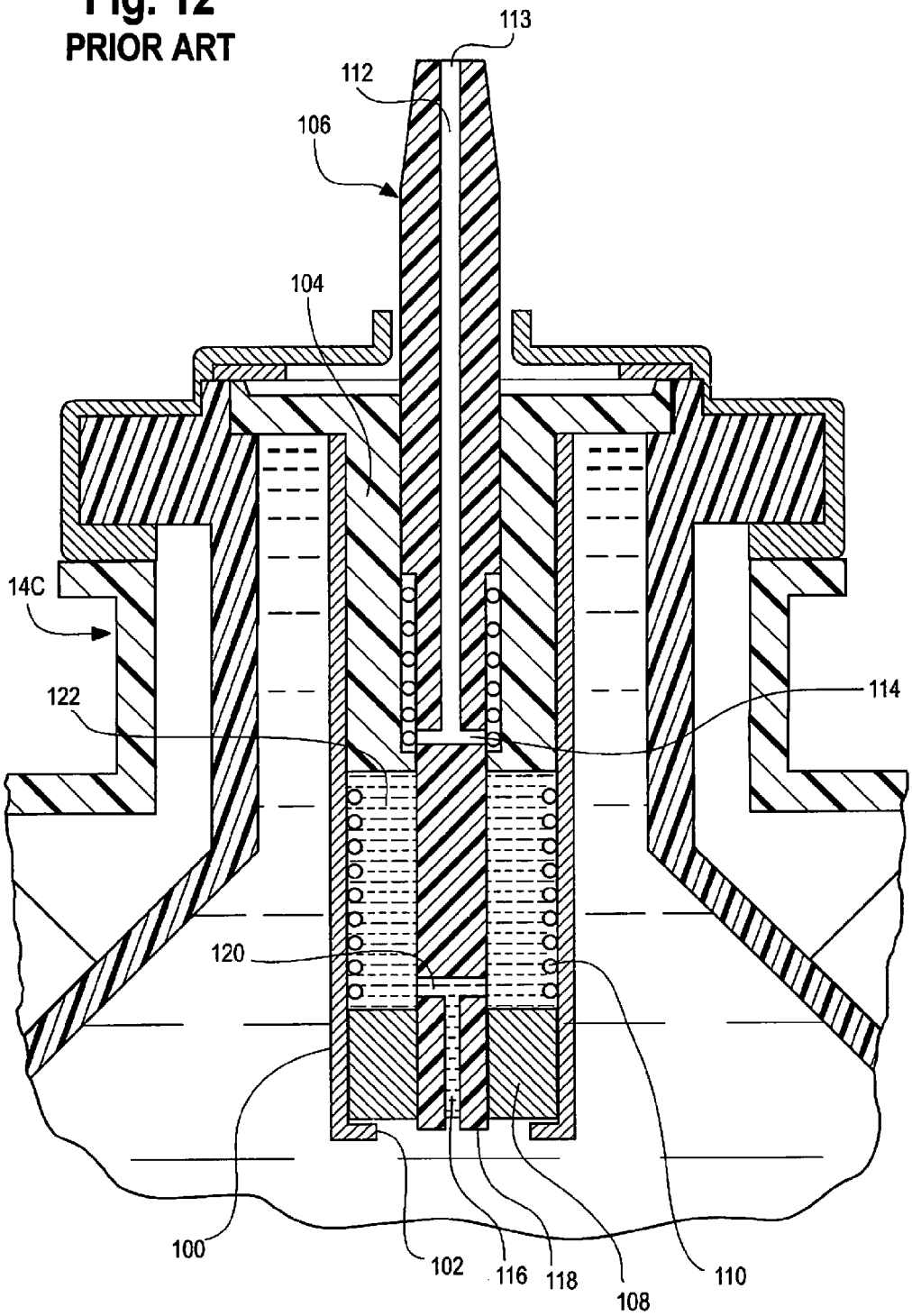
Fig. 12 PRIOR ART
FIG. 12 is a cross-sectional view of a third valve 14C in accordance with the prior art with the stem of the valve elevated and the metering chamber full.
Figure 13:
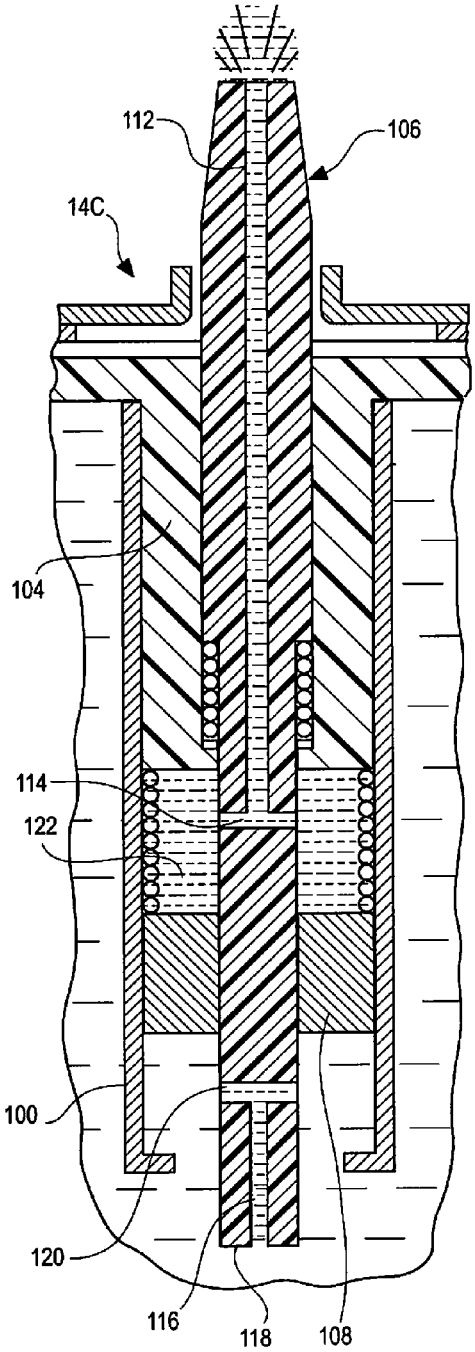
Fig. 13 PRIOR ART
FIG. 13 is another cross-sectional view of the valve shown in FIG. 12 with the stem depressed and the metering chamber empty.

Referring to FIGS. 12 and 13, an alternative method of providing a unit dispensing device that does not employ a flexible member such as members 28, or 62 as described above is to provide an axially moveable piston. The simplest example of a piston operated unit dose dispenser is described and depicted in my previously issued U.S. Pat. No. 5,183,187. Only the elements of this device that are relevant to the present invention are described herein, because the other elements are described in full in U.S. Pat. No. 5,183,187, and this patent is also incorporated herein by reference.

The piston operated valve 14C includes a tubular housing 100 having a inwardly directed flange 102 at the lower end thereof and a tubular plug 104 fitted in the upper end thereof for slideably receiving an axially moveable stem 106. Between the lower surface of the tubular plug 104 and the inwardly directed flange 102 is an axially moveable piston 108 having an aperture therein for slideably receiving the lower end of the stem 106. A spring 110 urges the piston 108 away from the tubular plug 104 and against the radial flange 102. Between the upper surface of the piston 108 and the lower surface of the tubular plug 104 is a metering chamber 122. The stem 106 has an axial upper passage 112 that extends from the upper end 113 and opens through a port 114 midway along the length thereof. Spaced below the port 114 is a second lower passage 116 that extends from the lower end 118 of the stem 106 to a second port 120 spaced a short distance below the upper port 114.

When the stem 106 is in an elevated position as shown in FIG. 12, the second port 120 opens into the metering chamber 122 and allows liquid formulation to enter through the second passage 116 to fill the chamber 122. When the chamber 122 is filled with liquid formulation 16 and the stem 106 is depressed to the position shown in FIG. 13, the lower port 120 is moved below the metering chamber 122 and the upper port 114 is moved into the metering chamber 122 allowing the contents of the chamber 122 to be released through the upper passage 112 to the ambient.

Figure 14:
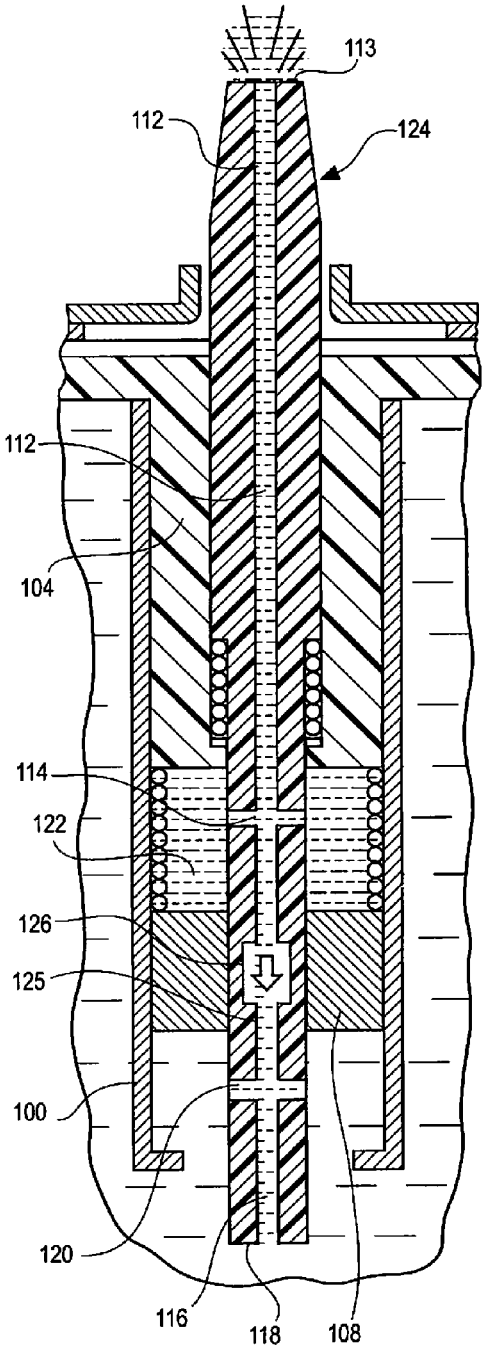
FIG. 14 is a cross-sectional view of a valve of the type shown in FIGS. 12 and 13 having a replacement stem in accordance with the present invention.

Referring to FIG. 14, the piston operated valve 14C can be made refillable through the upper end 113 of a replacement stem 124 that has a third passage 125 that connects the upper passage 112 to the lower passage 116 and includes a one-way valve 126 between the upper and lower ends thereof. The one-way valve 126 allows liquid to flow from the upper passage 112 to the lower passage 116 and out the lower end 118 of the stem 124 to thereby fill the bag 18 through the stem 124. On the other hand, the one-way valve 126 prevents the contents of the bag 18 from being discharged through the stem 124 except when the stem 124 is depressed and the device operates in accordance with the prior art.

Figure 15:
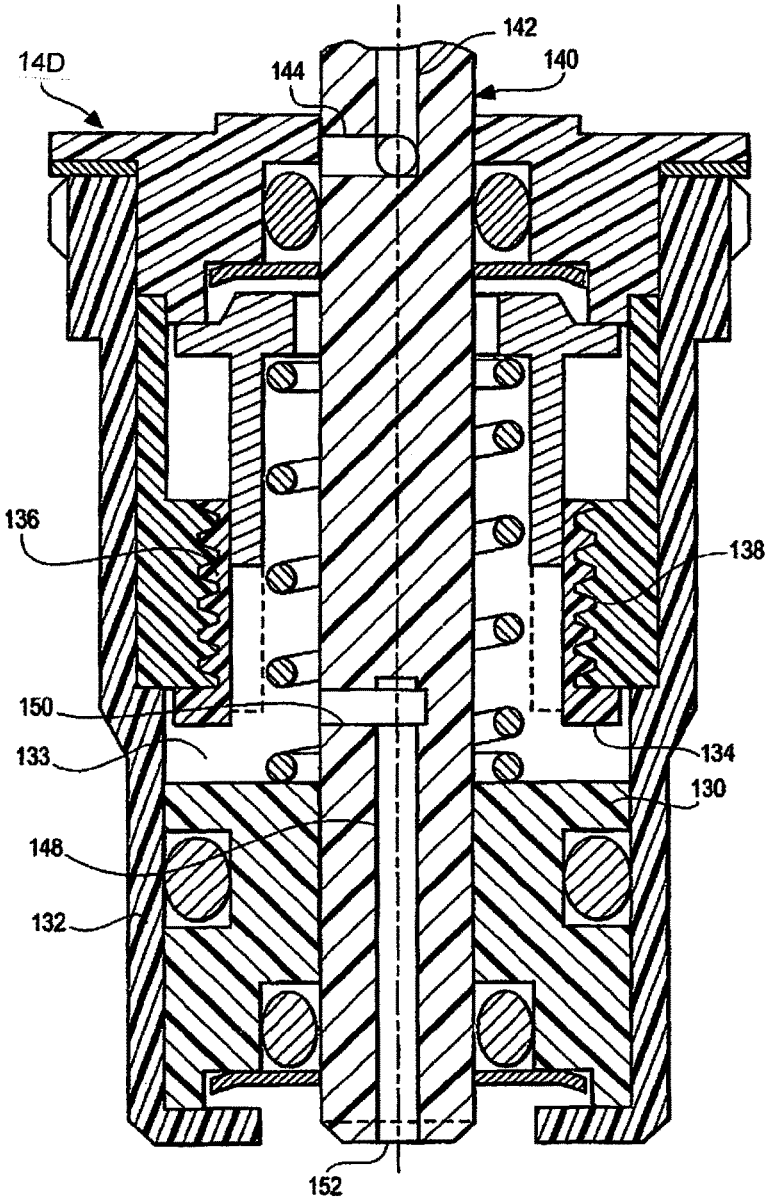
Fig. 15 PRIOR ART
FIG. 15 is a cross-sectional view of a fourth valve 14D in accordance with the prior art with the stem in the elevated position.

The piston operated device can be made with many variations. Specifically, the device can be made such that rotation of the stem changes the length of movement of the piston within its tubular housing. Such a device 14D is shown in FIG. 15. This device is depicted as a second embodiment in my previously issued U.S. Pat. No. 5,183,187, which has already been incorporated herein by reference. In this embodiment a piston 130 is vertically moveable within a tubular housing 132. A metering chamber 133 is positioned above the piston 130, and upward movement of the piston 130 is limited by the lower surface 134 of a second sleeve 136 having a threaded outer surface 138. The threads 138 of second sleeve 136 engage complementary threads, unnumbered, on the inner surface of the housing wall. The second sleeve 136 is fixed for rotation with the axially moveable stem 140 such that rotation of the stem 140 in one direction elevates the lower surface 134 and increases the length of the stroke of the piston 130, and rotation of the stem 140 in the other direction shortens the length of the stroke of the piston. Rotation of the stem 140 therefore changes the volume of the formulation 16 that is discharged with each actuation of the stem 140.

The stem 140 has an upper passage 142 that extends from a port 144 midway along the length of the stem 140 to the upper end thereof, not shown, and a lower passage 148 that extends from a second port 150 positioned below port 144 to the bottom end 152 of the stem 140. The lower port 150 is within the chamber 133 when the valve 14D is not discharging formulation 16 but is moved out of the chamber 133 just before the upper port 144 is moved into the chamber 133 when the stem 140 is depressed to discharge a dosage of formulation 16.

Figure 16:
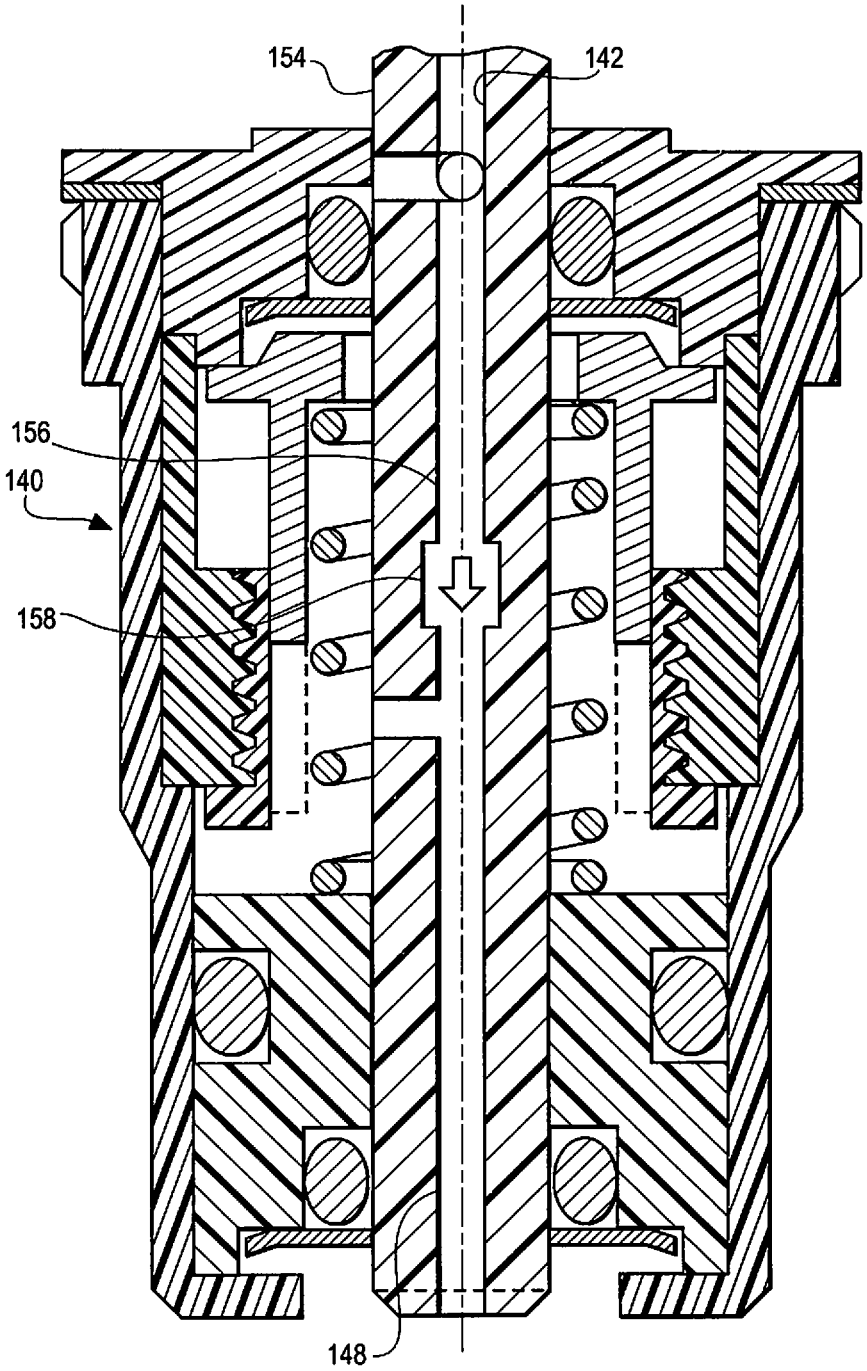
FIG. 16 is a cross-sectional view of the valve shown in FIG. 15 with a stem in accordance with the present invention.

Referring to FIG. 16, the valve 14C can be made fillable through the stem by providing a replacement stem 154 having an upper passage 142 and a lower passage 148 as previously described and further having a connecting passage 156 joining the upper passage 142 to the lower passage 148. A one-way valve 158 positioned in passage 156 prevents fluid from the bag from entering the lower passage 148 and passing through the connecting passage 156 to reach the upper end 146.

Referring to FIGS. 17 through 20, a much more complex embodiment of a piston operated dispensing valve 14E is shown in my previously issued U.S. Pat. No. 6,695,175 B2, which is also incorporated herein by reference. Valve 14E also includes a metering chamber 160 within a tubular housing 161 which is filled and discharged by means of an axially moveable piston 162, like the previous embodiments depicted. The volume of the metering chamber 160 is changed by rotating an axially moveable stem 164. A float 165 rests on top of the piston 162 and is rotatable with stem 164, and projections 166 at the upper end of the float 165 contact portions of an irregularly shaped surface 170 to change the length of the stroke of the piston 162.

Figure 17:
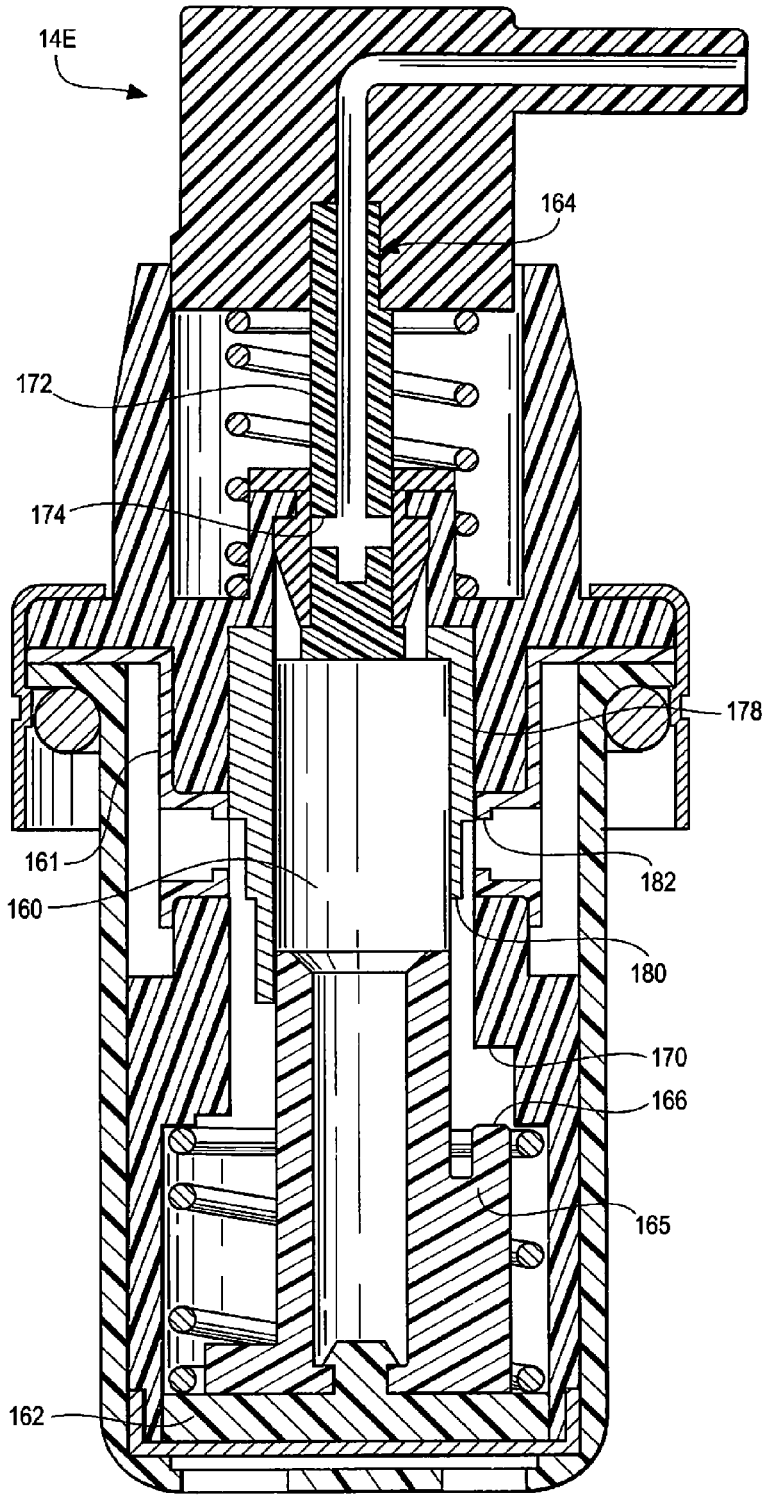
Fig. 17 PRIOR ART
FIG. 17 is a cross-sectional view of a fifth valve 14E in accordance with the prior art with the stem in the elevated position.
Figure 18:
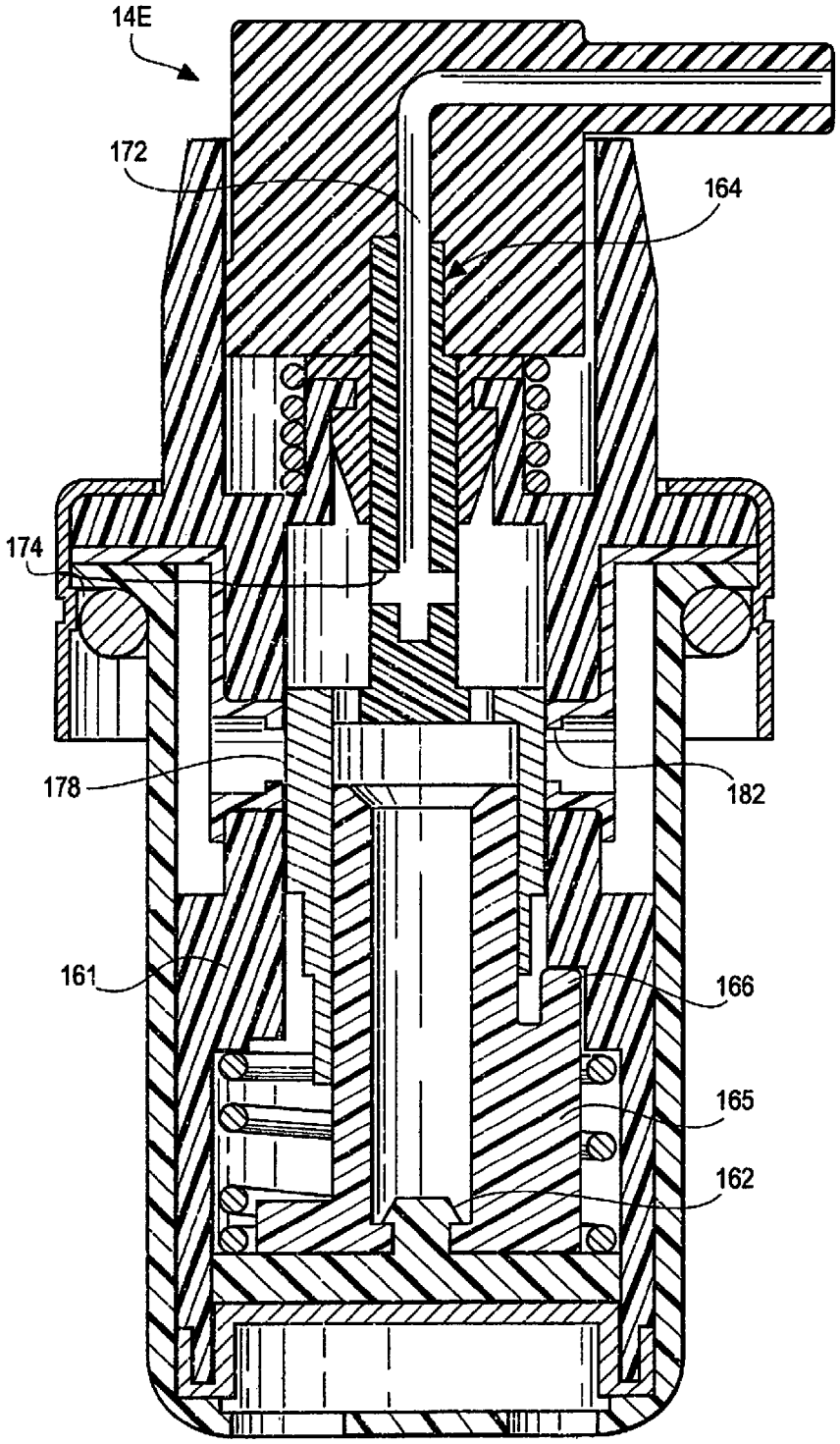
Fig. 18 PRIOR ART
FIG. 18 is a second cross-sectional view of the valve shown in FIG. 17 with the stem depressed and the piston elevated to discharge liquid.

As shown in FIGS. 19 and 20, the stem 164 has a small diameter upper tubular portion 171 with an upper passage 172 extending from a port 174 midway along the length thereof to the upper end 176 to provide a passage for discharging formulation 16. The stem 164 also has an enlarged tubular lower portion 178 with a central opening 179. The wall of the lower portion has an axial slot 180 therein that extends from the bottom of the stem 164 to midway along the lower portion. As shown in FIG. 17, the slot 180 allows liquid to fill the metering chamber 160 through a side port 182 in the housing 161 when the stem 164 is in the elevated position. When the stem 164 is depressed, as shown in FIG. 18, the cylindrical wall 178 of the stem blocks the side port 182 and moves port 174 of the stem 164 into the metering chamber 160. The piston 162 is then urged upward by the propellant in the container to discharge formulation 16 in the metering chamber 160 through the passage 172 to the ambient.

Referring to FIG. 21, the valve 14E can be made so that it is fillable through the upper end 176 of a replacement stem 183 by the provision of an additional passage 184 having an upper end that communicates with the discharge passage 172 and a lower end that communicates with the central opening 179 of the lower tubular portion 178. A one-way valve, in the form of a flap 186, prevents the passage of fluid at the lower end of the stem 183 from reaching the discharge passage 172. The additional passage 184 permits fluid injected into passage 172 to pass through the flap 186 to the bag in the container to thereby fill the bag but prevents liquid in the bag 18 from escaping though the passage 184.

Figure 22:
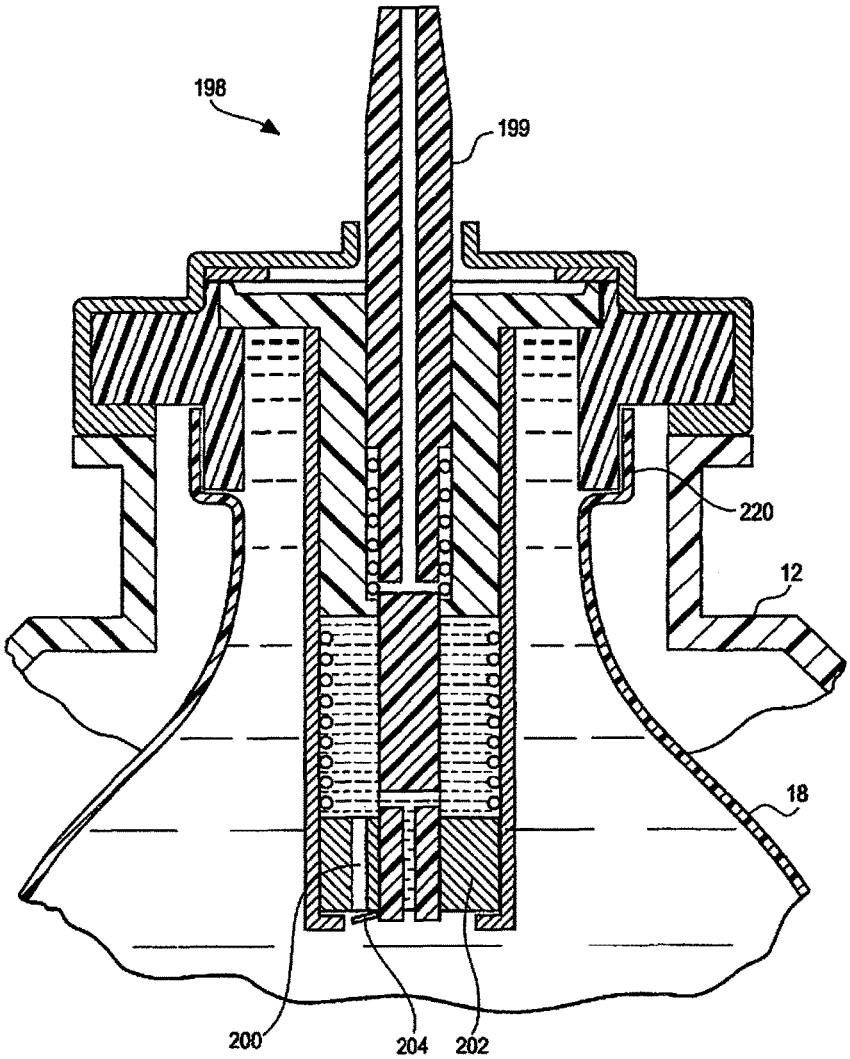
FIG. 22 is cross sectional view of a piston suitable for use in the embodiment shown in FIG. 12 where the piston defines a fill passage.
Figure 23:
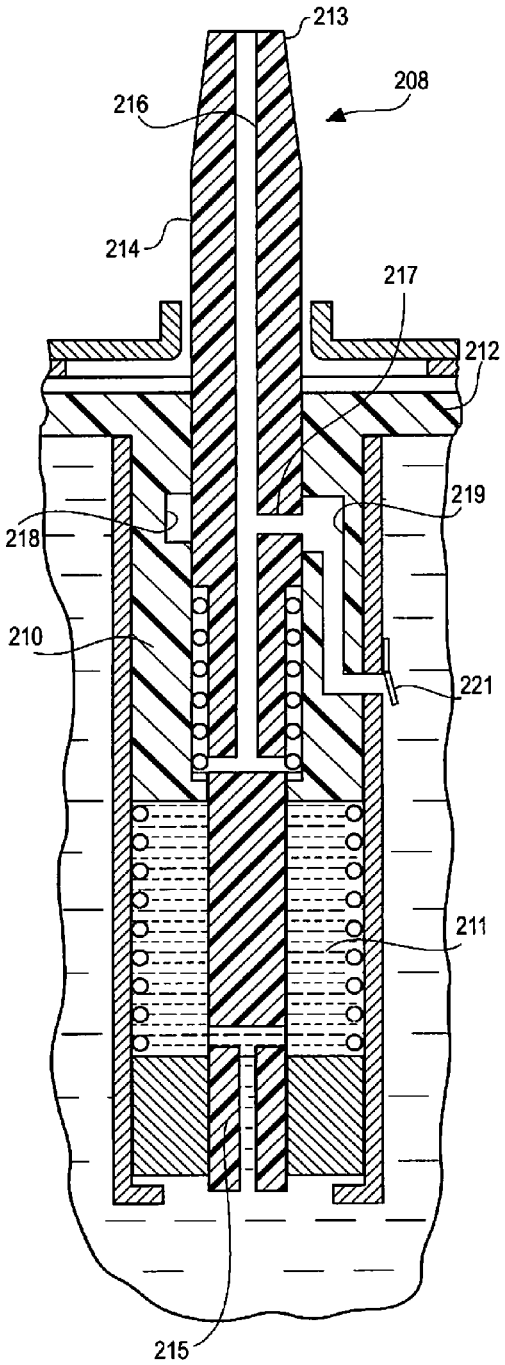
FIG. 23 is cross sectional view of a metering valve and container having a fill passage that is independent of the stem.

Referring to FIG. 22, a piston operated device 198 is shown that may operate similar to any of the devices depicted in FIGS. 12, 15 and 17. The device 198 may also be fellable through the stem 198 thereof by a passage 200 through the body portion of the piston 202. Within the passage 200 is a one-way valve 204 that allows liquid to flow from the enclosed metering chamber (122 in FIG. 12, 133 in FIG. 15, 160 in FIG. 17) to the interior of the retaining bag 18 but will prevent liquid from flowing or otherwise passing from the bag 18 through the piston 202 to the metering chamber. The one-way valve may be in any form known in the art including a simple flap valve as shown. To fill the bag 18 of such a piston operated device, the actuator stem, not shown, must be depressed so that the discharge passage in the stem is opened to the metering chamber. Accordingly, with the actuator stem depressed, formulation may be injected into the discharge nozzle of the valve (valve 106 in FIG. 12, valve 14D in FIG. 15 and valve 14E in FIG. 17) causing the liquid formulation to flow through the metering chamber, through passage 200 in the body of the associated piston 200 and into the retaining bag 18. The one-way valve 204 will prevent pressurized liquid in the container from passing through the passage 200 in the piston without moving the piston, and therefore the device will operate as intended The bag 18 of a metering valve may also be filled through a port in the side wall of the of the moveable stem. Referring to FIG. 23 in which valve 208 is representative of all such metering valves, includes a tubular body 210 the lower end of which extends into the container 12 and the bag 18. The upper end of the tubular body 210 includes an annular flange 212 that is adapted to be retained against the mouth of the container 12, and slideably received in the central opening of the body 210 is a depressible actuator stem 214. The actuator stem 214 is a tubular member having a dispensing nozzle, not shown, at the upper end 213 thereof. At its lower end the actuator stem 214 includes passages 215 as needed to fill a adapted to fill a metering chamber 211 for dispensing a fixed volume of liquid on each actuation such as provided by any one of the types of valves described above.

The actuator stem 214 has a longitudinal discharge bore 216 through which the formulation is discharged. It should be apparent that the operating structure at the lower end 215 of the actuator stem 214 closes off the bore 216 from the metering chamber when the actuator stem 214 is in the elevated position. In accordance with the invention, along the length of the actuator stem 214, at a position below the annular flange 212 when the actuator stem 214 is in is in the elevated position, is an aperture 217 through the wall thereof. The inner wall of the central opening of the tubular body 210 has an annular groove 218 that is aligned with the aperture 217 in the actuator stem 214 when it is in the elevated position, and a passage 219 extends through the wall of the tubular body 210 with one end opening into the annular groove 218 and the other end opening below the attachment 220 for retaining the bag 18. A one-way valve 221 is provided to control the movement of fluid through the path defined by the aperture 217, around the annular groove 218 and the passage 219. As depicted in FIG. 23 the one-way valve 221 is a moveable flap that extends across the opening to passage 219, but the valve 221 may have any of many configurations known in the art and can be positioned anywhere along the defined path. The one-way vale 221 prevents liquid inside the bag 18 from escaping through the defined path but allows pressurized formulation injected into the nozzle at the upper end 213 to pass through the path and fill the bag 18.

It should be apparent that formulation injected into the actuator stem 214 while the stem 214 is in the elevated position cannot reach the metering chamber because the passage to the metering chamber is closed when the stem is in this position. It should also be apparent that once the bag 18 has been filled with the formulation pressure from the propellant that surrounds the bag 18 will apply force against the outer surface of a flap type one-way valve and maintain it in a closed condition. Also, formulation released into the discharge passage on actuation of the valve 208 will not flow back into the bag 18 through the defined path because the pressure of the formulation being discharged is less than the pressure within the bag 18.

Figure 24:
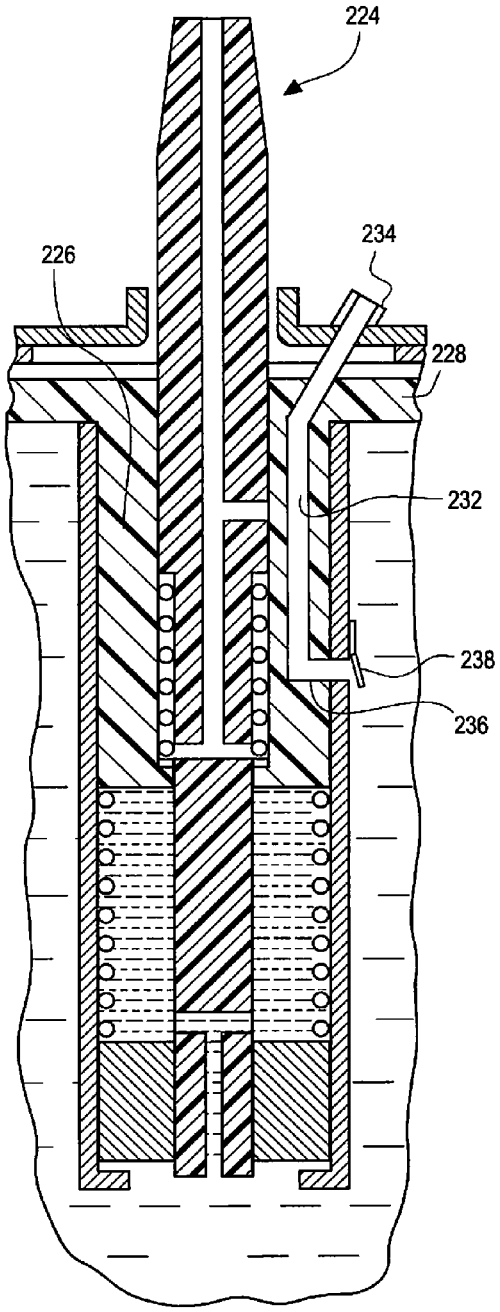
FIG. 24 is cross section of another metering valve having a fill passage that extends through the wall of the stem.

The bag of a metering valve may also be filled through a port on the valve that is independent of the actuator and the discharge passage. Referring to FIG. 24 in which valve 224 is representative of all such metered dispensing valves. The valve 224 includes a tubular body 226 the lower end of which extends into the container 12 and the bag 18. The upper end of the tubular body 226 includes an annular flange 228 that is adapted to be retained against the mouth of the container 12, and slideably received in the central opening of the body 226 is a depressible actuator 230.

In accordance with this embodiment the tubular body 226 has a passage 232 therein that has an upper end opening on the upper surface thereof into which is fitted a filling port 234. The lower end 236 of the passage 232 opens inside the bag 18, and between the filling port 234 and the lower end 236 is a one way-valve 238 that allows liquid formulation to flow from the filling port 234 into the bag 18 but will not allow liquid in the bag 18 to escape to the ambient through the passage 232. It should be appreciated that although the one-way valve 238 is depicted as positioned midway along the length of the passage 232 it may be positioned anywhere along its length. In fact, the one-way valve 238 may be in the form of a flap that closes off the lower end 236 opening to the passage as has been described above.

All of the embodiments of the present invention provide a fill passage that allow the bag 18 to be filled with formulation after the metering valve and bag 18 have been assemble to the container 12 and the container has been pressurized with a propellant.

While the present invention has been described with respect to several embodiments, it will be understood that many modifications and variations can be made without departing from the spirit and scope of the invention. It is therefore the intent of the appended claims to cover all such modifications and variations that fall within the spirit and scope of the invention.

What is claimed:

1. A dispensing device, comprising:

a container having an aperture, a discharge valve in said aperture, said discharge valve including a dispensing structure for dispensing a volume of liquid formulation on each actuation of said valve, said discharge valve having an axially moveable stem with an upper portion extending to ambient and a lower portion extending within said container, a bag in said container, said bag enclosing said lower portion of said discharge valve, a propellant surrounding said bag such that said propellant provides pressure within said bag, a liquid formulation in said bag, a fill passage defined by the stem of said discharge valve, with said fill passage having a first opening to ambient and a second opening into said bag, and a one-way valve disposed in operable combination with said fill passage for allowing liquid formulation to flow through said fill passage from said ambient into said bag while preventing liquid formulation in said bag flowing through said fill passage to said ambient whereby permitting said bag to receive said liquid formulation through the fill passage from outside of said dispensing device.

2. The dispensing device of claim 1 wherein said one-way valve is a flap operably disposed to prevent the liquid formulation in said bag from entering said fill passage.

3. The dispensing device of claim 1 and further comprising said discharge valve including a vertically moveable stem and a metering chamber wherein said discharge valve discharges a predetermined amount of formulation on each actuation of said moveable stem, a discharge passage in said stem, and said fill passage independent of said discharge passage.

4. The dispensing device of claim 1 and further comprising:

said discharge valve including a metering chamber for discharging a predetermined amount of liquid formulation on each actuation of said valve, a discharge passage in said stem, and with said fill passage communicating with said discharge passage.

5. The dispensing device of claim 4 wherein said discharge passage includes an aperture in a wall of said stem.

6. The dispensing device of claim 4 wherein said metering chamber has a flexible wall.

7. The dispensing device of claim 4 wherein said discharge valve has a moveable piston forming a wall of said metering chamber.

8. A dispensing device, comprising:

a container having an aperture, a discharge valve in said aperture, said discharge valve including a dispensing structure for dispensing a volume of liquid formulation on each actuation of said valve, with said discharge valve having an axially moveable stem with an upper portion extending to ambient and a lower portion extending within said container, and wherein said discharge valve is a metering valve for dispensing a predetermined volume of liquid formulation on each actuation of said valve, and with said stem being rotatable for changing said predetermined volume of liquid formulation to be dispensed, a bag in said container, said bag enclosing said lower portion of said discharge valve, a propellant surrounding said bag such that said propellant provides pressure within said bag, a liquid formulation in said bag, a fill passage defined by the stem of said discharge valve, with said fill passage communicating with a discharge passage defined by said discharge valve, with said fill passage having a first opening to ambient and a second opening into said bag, and a one-way valve in said fill passage, wherein said one-way valve allows liquid to flow through said fill passage from said ambient into said bag and prevents liquid in said bag flowing through said fill passage to said ambient whereby permitting said bag to receive said liquid formulation through the fill passage from outside of said dispensing device.

9. The dispensing device of claim 8 wherein said one-way valve is a flap operably disposed to prevent liquid formulation in said bag from entering said fill passage.

10. The dispensing device of claim 8 wherein said discharge passage includes an aperture in a wall of said stem, with said discharge passage communicating with said fill passage through said aperture.

11. The dispensing device of claim 8 wherein said discharge valve has a moveable piston forming a wall of said metering chamber.

12. In a dispensing device for dispensing a volume of liquid formulation, said device including a container having an aperture, a discharge valve in said aperture, said discharge valve having a moveable stem, with an upper portion of said valve extending outside of said container to ambient and a lower portion of said valve extending within said container, a bag in said container, wherein said bag encloses the lower portion of said discharge valve, a propellant surrounding said bag, and a liquid formulation in said bag, wherein said discharge valve has the improvement comprising:

a fill passage defined by the stem of said discharge valve and extending from the ambient through the lower portion of said discharge valve and opening into said bag, and a one-way valve operably disposed in said fill passage for preventing liquid from within said bag from passing through said fill passage to said ambient and allowing said bag to be filled with liquid formulation from outside said dispensing device.

13. The improvement of claim 12 wherein said discharge valve is a metering valve having a metering chamber for dispensing a predetermined volume of liquid formulation on each actuation of said valve, and with said metering chamber further comprising a flexible wall.

14. The improvement of claim 12 wherein said one-way valve is a flap that extends across an aperture to prevent liquid from entering said fill passage from said bag.

15. In a dispensing device for dispensing a volume of liquid formulation, said device including a container having an aperture, a discharge valve in said aperture, said discharge valve having an upper portion extending outside of said container to ambient and a lower portion extending within said container, a bag in said container, wherein said bag encloses the lower portion of said dispensing valve, a propellant surrounding said bag, and a liquid formulation in said bag, wherein said discharge valve has the improvement comprising:

wherein said discharge valve is a metering valve having a vertically moveable stem and a metering chamber for dispensing a predetermined volume of liquid formulation on each actuation of said stem, with said stem being rotatable for changing the volume of liquid formulation discharged on each actuation of said valve, with said stem defining a discharge passage, a fill passage defined by said discharge valve and extending from the ambient through the lower portion of said discharge valve and opening into said bag, with said fill passage communicating with said discharge passage, and a one-way valve for preventing liquid formulation from within said bag from passing through said fill passage to said ambient and allowing said bag to be filled with liquid formulation from outside said dispensing device.

16. The device of claim 15 wherein said discharge passage includes an aperture in a wall of said stem and said discharge passage communicates with said fill passage through said aperture.

17. The dispensing device of claim 15 wherein said discharge valve has a moveable piston forming a wall of said metering chamber.

18. A discharge valve including a dispensing structure for dispensing a volume of liquid formulation on each actuation of said valve, said discharge valve having an axially elongated moveable stem, with an upper portion of said stem defining a discharge passageway and a first outlet and with a lower portion of said stem defining a second outlet, with said stem further defining a fill passage communicating with said discharge passageway and said second outlet, and a one-way valve disposed in operable combination with said fill passage for allowing a liquid formulation to flow through said fill passage from said discharge passageway toward said second outlet while preventing liquid formulation from flowing through said fill passage to discharge passageway.

19. A method for filling a dispensing device including a container having an aperture, a discharge valve in said aperture, said discharge valve including a dispensing structure for dispensing a volume of liquid formulation on each actuation of said discharge valve, said discharge valve having an axially moveable stem with an upper portion extending to ambient and a lower portion extending within said container, a bag in said container, said bag enclosing the lower portion of said discharge valve, a propellant surrounding said bag, wherein said propellant provides pressure within said bag, a liquid formulation in said bag, said method comprising the steps of:

configuring said discharge valve such that a fill passage is defined by the stem of said discharge valve and opens to ambient and to said bag;

permitting liquid formulation to flow through said fill passage from said ambient into said bag; and preventing liquid formulation in said bag from flowing through said fill passage to ambient whereby allowing said bag to be filled with said liquid formulation from outside said dispensing device.

20. The method according to claim 19 further comprising the step of:

configuring said discharge valve to control the volume of liquid formulation dispensed from said dispensing device upon rotation of said stem.

21. The method according to claim 19 further comprising the step of:

providing said discharge valve with a metering chamber such that said discharge valve discharges a predetermined amount of liquid formulation on each actuation of said discharge valve.

* * * * *